US007385558B2

(12) United States Patent
Krupa

(10) Patent No.: US 7,385,558 B2
(45) Date of Patent: Jun. 10, 2008

(54) CAPACITIVE FEED ANTENNA

(75) Inventor: Steve Krupa, Cambridge (GB)

(73) Assignee: Galtronics Ltd., Tiberias (IL)

( * ) Notice: Subject to any disclaimer, the term of this patent is extended or adjusted under 35 U.S.C. 154(b) by 0 days.

(21) Appl. No.: 11/357,371

(22) Filed: Feb. 16, 2006

(65) Prior Publication Data

US 2006/0197708 A1 Sep. 7, 2006

Related U.S. Application Data

(60) Provisional application No. 60/673,588, filed on Apr. 21, 2005, provisional application No. 60/654,013, filed on Feb. 17, 2005.

(51) Int. Cl.
*H01Q 1/24* (2006.01)
*H01Q 1/38* (2006.01)

(52) U.S. Cl. ..... 343/702; 343/700 MS; 343/833; 343/834

(58) Field of Classification Search ..... 343/702, 343/700 MS, 833, 834, 846, 850
See application file for complete search history.

(56) References Cited

U.S. PATENT DOCUMENTS 4,218,685 A 8/1980 Frosch et al.
5,617,102 A 4/1997 Prater
5,764,190 A 6/1998 Murch et al.
6,639,558 B2 10/2003 Kellerman et al.
6,650,294 B2 11/2003 Ying et al.
6,680,705 B2 1/2004 Tan et al.
6,853,339 B2 2/2005 Sievenpiper et al.
7,053,844 B2 5/2006 Gaucher et al.
7,136,019 B2 * 11/2006 Mikkola et al. ..... 343/702
7,202,818 B2 * 4/2007 Anguera Pros et al. ..... 343/700 MS
2005/0190106 A1 9/2005 Anguera Pros et al.
2005/0195124 A1 * 9/2005 Puente Baliarda et al. . 343/893

OTHER PUBLICATIONS

International Search Report dated Jan. 3, 2007 for PCT Patent Application PCT/IL2007/00201.
U.S. Appl. No. 60/654,013, filed Feb. 17, 2005.
U.S. Appl. No. 60/673,588, filed Apr. 21, 2005.

* cited by examiner

*Primary Examiner*—Hoang V Nguyen
(74) *Attorney, Agent, or Firm*—Darby & Darby PC

(57) ABSTRACT

An antenna including a first monopole radiating element having a galvanic connection to an antenna feed and second and third monopole radiating elements having a capacitive connection to the antenna feed.

20 Claims, 4 Drawing Sheets

212
218
216
214
226
242
248
246
249
228
220
250
258
240
200
260
206
210
204

242
248
249
222
232
240
224
226
234
212
218
220
206
204
200

CAPACITIVE FEED ANTENNA

REFERENCE TO RELATED APPLICATIONS

The present application is related to U.S. Provisional Patent Application Ser. No. 60/654,013 filed Feb. 17, 2005, and entitled CERAMIC FED MULTI-POLE ANTENNA and to U.S. Provisional Patent Application Ser. No. 60/673,588 filed Apr. 21, 2005, and entitled ANTENNAS, the disclosures of which are hereby incorporated by reference and priority of which is hereby claimed pursuant to 37 CFR 1.78(a) (4) and (5)(i).

FIELD OF THE INVENTION

The present invention relates to antennas generally and more particularly to capacitive feed antennas.

BACKGROUND OF THE INVENTION

The following patent documents are believed to represent the current state of the art:

U.S. Pat. Nos. 6,680,705 and 5,764,190.

SUMMARY OF THE INVENTION

The present invention seeks to provide an improved capacitive antenna.

There is thus provided in accordance with a preferred embodiment of the present invention an antenna including a first monopole radiating element having a galvanic connection to an antenna feed and second and third monopole radiating elements having a capacitive connection to the antenna feed.

In accordance with a preferred embodiment of the present invention the antenna also includes a capacitor providing the capacitive connection, the capacitor including a dielectric cylinder supporting the second and third monopole radiating elements and a conductive connection assembly extending interiorly of the dielectric cylinder and having a galvanic connection with the antenna feed.

In accordance with another preferred embodiment of the present invention the second and third monopole radiating elements are defined by a single bent wire having first and second portions having differing lengths. Preferably, the first and second portions having differing lengths have respective first and second ends which lie in mutually spaced coplanar overlapping relationship. Additionally or alternatively, the antenna feed is integrally formed with the first monopole radiating element.

There is also provided in accordance with a further preferred embodiment of the present invention an antenna including first and second monopole radiating elements having a galvanic connection to an antenna feed and a third monopole radiating element having a capacitive connection to the antenna feed.

In accordance with a further preferred embodiment of the present invention the antenna also includes a capacitor providing the capacitive connection, the capacitor including a dielectric cylinder supported on the second and third monopole radiating elements and supporting the third monopole radiating element.

In accordance with yet a further preferred embodiment of the present invention the first and second monopole radiating elements are defined by a single bent wire having first and second portions having differing lengths. Preferably, the first and second portions having differing lengths have respective first and second ends which lie in mutually spaced coplanar overlapping relationship.

In accordance with an additional preferred embodiment of the present invention the antenna feed engages an electrically conductive surface of a printed circuit board.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1A:
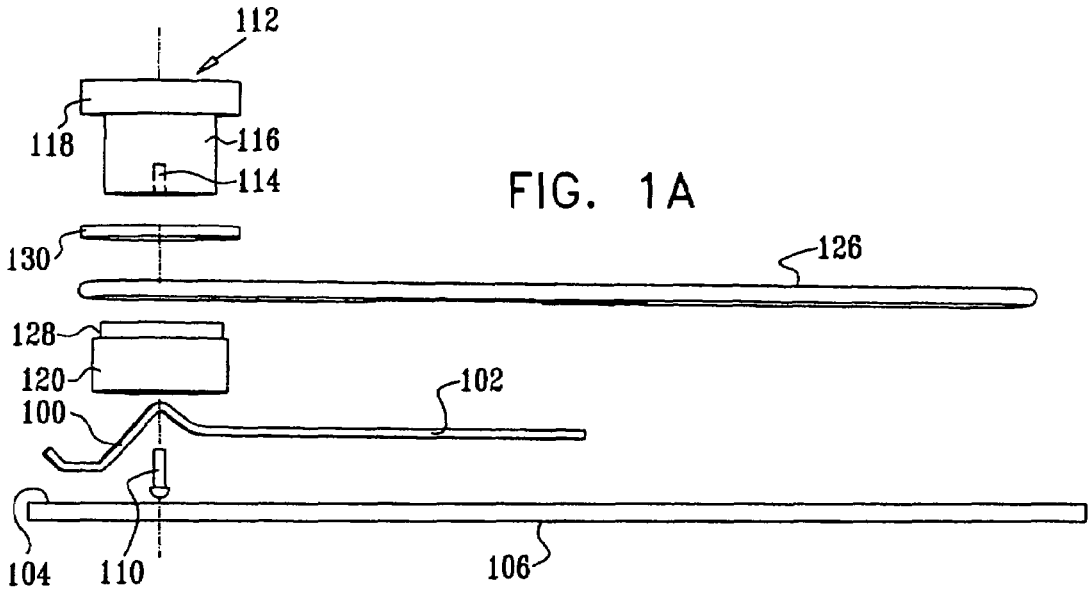
FIGS. 1A, 1B, 1C and 1D are respective simplified exploded view, pictorial, top view and sectional view illustrations of a preferred embodiment of an antenna constructed and operative in accordance with the present invention, the sectional illustration being taken along respective section lines ID-ID in FIG. 1C.
Figure 1B:
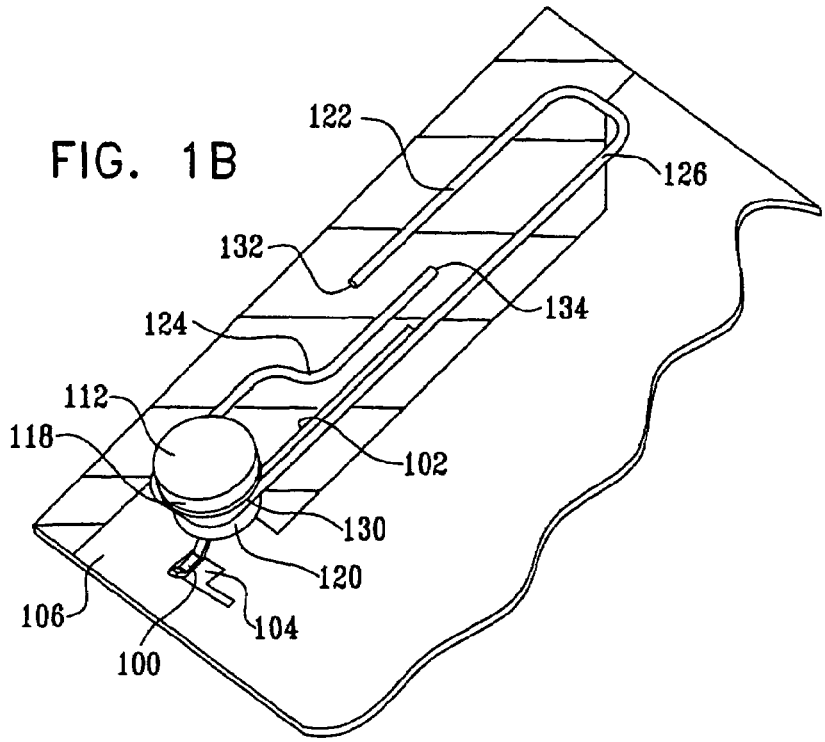
Figure 1C:
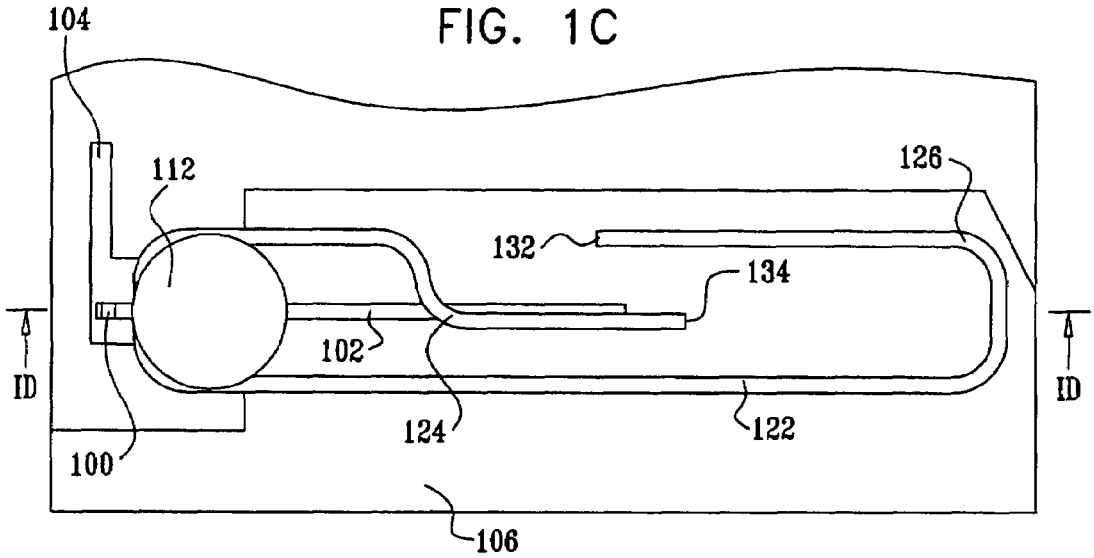
Figure 1D:
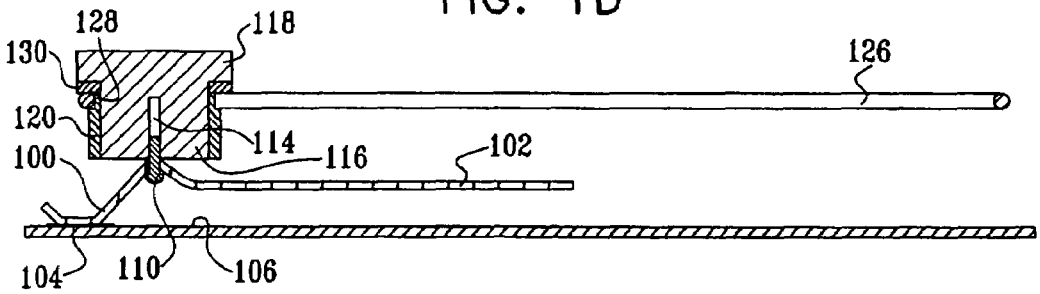

Reference is now made to FIGS. 1A-1D, which illustrate an antenna constructed and operative in accordance with a preferred embodiment of the present invention.

As seen in FIGS. 1A-1D, the antenna comprises an antenna feed 100, which is typically integrally formed with a first monopole radiating element 102. The antenna feed 100 is preferably formed as a bent spring and is arranged to engage an electrically conductive surface 104 of a printed circuit board 106.

A fastener 110, preferably formed of an electrically conductive material, retains the antenna feed 100 and the monopole radiating element 102 in mechanical and electrical engagement with an electrically conductive element 112, preferably by being press-fit in a bore 114 formed therein.

Electrically conductive element 112 preferably includes a generally cylindrical portion 116 and a top flange 118. A dielectric sleeve 120 is preferably press fit about cylindrical portion 116. Second and third monopole radiating elements 122 and 124 are preferably defined by a single bent metal wire or other element 126 having respective first and second portions of differing lengths. Element 126 is preferably retained onto an outer surface of dielectric sleeve 120 and is preferably mechanically seated in a suitable recess 128 formed on the outer surface of dielectric sleeve 120. Element 126 is electrically insulated from top flange 118 by an insulative ring 130.

Preferably, the second and third radiating elements 122 and 124 have respective first and second ends 132 and 134 which lie in mutually spaced coplanar overlapping relationship.

It is appreciated that in an alternative embodiment, additional monopole radiating elements, in addition to elements 122 & 124, may be provided by suitable configuration of element 126.

Figure 2A:
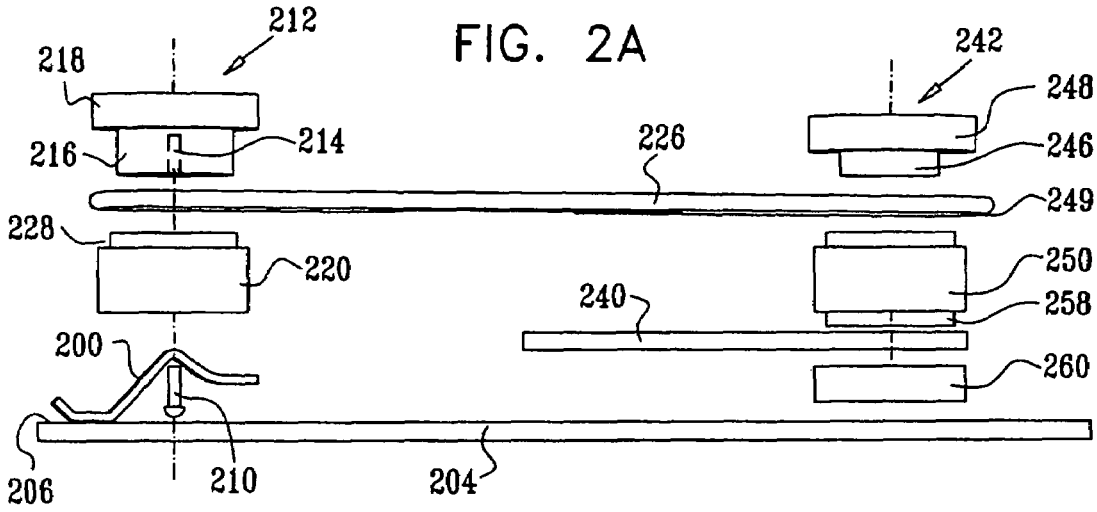
FIGS. 2A, 2B, 2C and 2D are respective simplified exploded view, pictorial, top view and sectional view illustrations of another preferred embodiment of an antenna constructed and operative in accordance with the present invention, the sectional illustration being taken along respective section lines IID-IID in FIG. 2C.
Figure 2B:
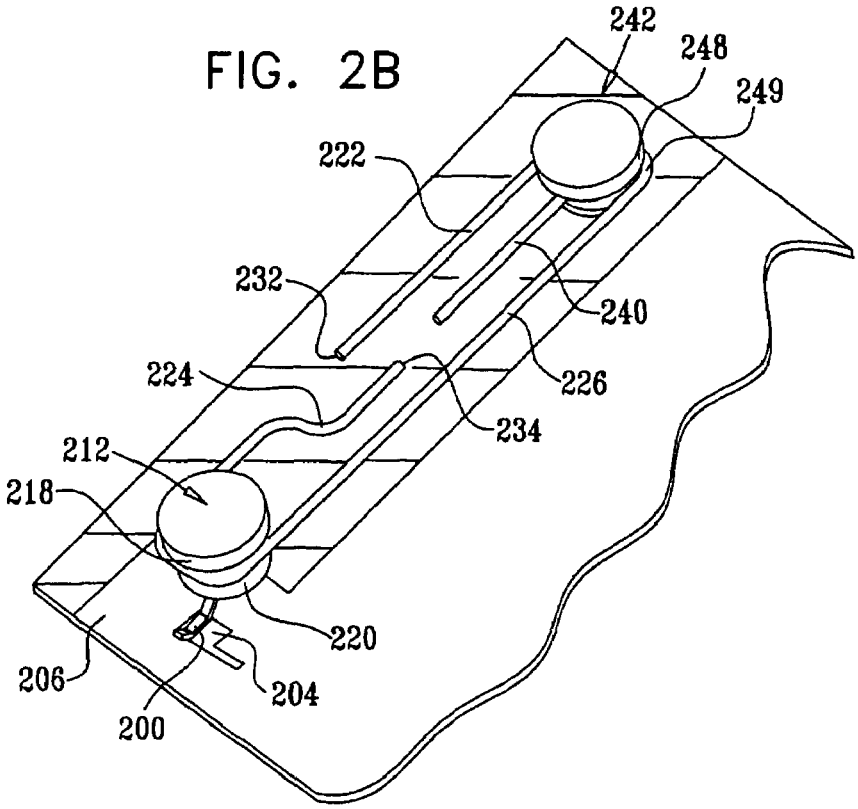
Figure 2C:
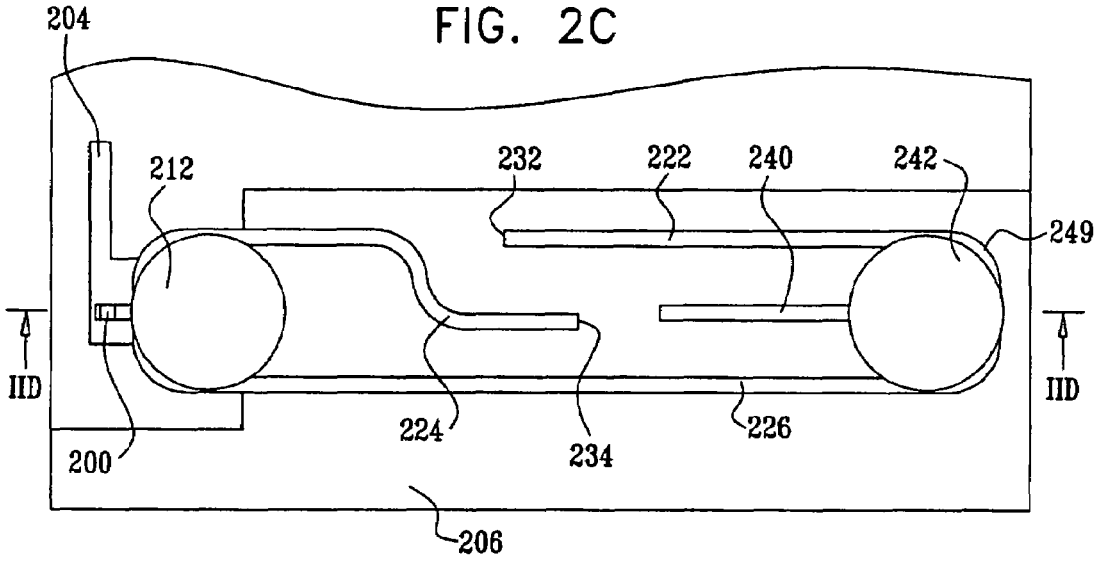
Figure 2D:
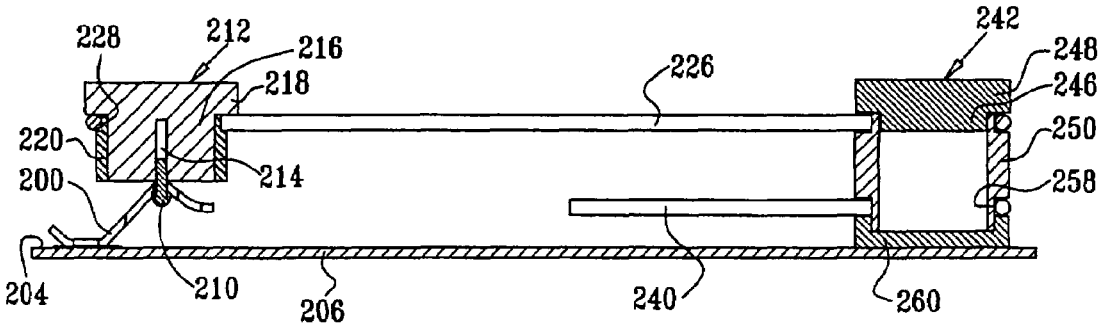

Reference is now made to FIGS. 2A-2D, which illustrate an antenna constructed and operative in accordance with another preferred embodiment of the present invention.

As seen in FIGS. 2A-2D, the antenna comprises an antenna feed 200, which is preferably formed as a bent spring and is arranged to engage an electrically conductive surface 204 of a printed circuit board 206.

A fastener 210, preferably formed of an electrically conductive material, retains the antenna feed 200 in mechanical and electrical engagement with an electrically conductive element 212, preferably by being press-fit in a bore 214 formed therein.

Electrically conductive element 212 preferably includes a generally cylindrical portion 216 and a top flange 218. A conductive sleeve 220 is preferably press fit about cylindrical portion 216. First and second monopole radiating elements 222 and 224, are preferably defined by a single bent metal wire or other element 226 having respective first and second portions of differing lengths. Element 226 is preferably retained onto an outer surface of conductive sleeve 220 and is preferably mechanically seated in a suitable recess 228 formed on the outer surface of conductive sleeve 220.

Preferably, the first and second radiating elements 222 and 224 have respective first and second ends 232 and 234 which lie in mutually spaced coplanar overlapping relationship.

A third monopole radiating element 240 is preferably capacitively fed by being insulatively mounted onto element 226.

An electrically insulative element 242, which preferably includes a generally cylindrical portion 246 and a top flange 248, is mounted at a bend 249 in element 226. An electrically insulative sleeve 250 is preferably press fit about cylindrical portion 246. Third monopole radiating element 240 is preferably retained onto an outer surface of insulative sleeve 250 and is preferably mechanically seated in a suitable recess 258 formed on the outer surface of insulative sleeve 250 and retained therein by an insulative retaining ring 260.

It is appreciated that in an alternative embodiment, additional monopole radiating elements, in addition to elements 222 & 224, may be provided by suitable configuration of element 226.

It is appreciated by persons skilled in the art that the present invention is not limited by what has been particularly shown and described hereinabove. Rather the scope of the present invention includes both combinations and subcombinations of various features described hereinabove as well as variations and modifications thereto which would occur to a person of skill in the art upon reading the above description and which are not in the prior art.

The invention claimed is:

1. An antenna comprising:

a first monopole radiating element having a galvanic connection to an antenna feed; and second and third monopole radiating elements having a capacitive connection to said antenna feed.

2. An antenna according to claim 1 and also comprising a capacitor providing said capacitive connection, said capacitor comprising:

a dielectric cylinder supporting said second and third monopole radiating elements; and a conductive connection assembly extending interiorly of said dielectric cylinder and having a galvanic connection with said antenna feed.

3. An antenna according to claim 2 and wherein said second and third monopole radiating elements are defined by a single bent wire having first and second portions having differing lengths.

4. An antenna according to claim 3 and wherein said first and second portions having differing lengths have respective first and second ends which lie in mutually spaced coplanar overlapping relationship.

5. An antenna according to claim 4, and wherein said antenna feed is integrally formed with said first monopole radiating element.

6. An antenna according to claim 2, and wherein said antenna feed is integrally formed with said first monopole radiating element.

7. An antenna according to claim 1 and wherein said second and third monopole radiating elements are defined by a single bent wire having first and second portions having differing lengths.

8. An antenna according to claim 7 and wherein said first and second portions having differing lengths have respective first and second ends which lie in mutually spaced coplanar overlapping relationship.

9. An antenna according to claim 3, and wherein said antenna feed is integrally formed with said first monopole radiating element.

10. An antenna according to claim 1, and wherein said antenna feed is integrally formed with said first monopole radiating element.

11. An antenna comprising:

first and second monopole radiating elements having a galvanic connection to an antenna feed; and a third monopole radiating element having a capacitative connection to said antenna feed.

12. An antenna according to claim 11 and also comprising a capacitor providing said capacitive connection, said capacitor comprising:

a dielectric cylinder supported on said second and third monopole radiating elements and supporting said third monopole radiating element.

13. An antenna according to claim 12 and wherein said first and second monopole radiating elements are defined by a single bent wire having first and second portions having differing lengths.

14. An antenna according to claim 13 and wherein said first and second portions having differing lengths have respective first and second ends which lie in mutually spaced coplanar overlapping relationship.

15. An antenna according to claim 13, and wherein said antenna feed engages an electrically conductive surface of a printed circuit board.

16. An antenna according to claim 12, and wherein said antenna feed engages an electrically conductive surface of a printed circuit board.

17. An antenna according to claim 11 and wherein said first and second monopole radiating elements are defined by a single bent wire having first and second portions having differing lengths.

18. An antenna according to claim 17 and wherein said first and second portions having differing lengths have respective first and second ends which lie in mutually spaced coplanar overlapping relationship.

19. An antenna according to claim 17, and wherein said antenna feed engages an electrically conductive surface of a printed circuit board.

20. An antenna according to claim 11, and wherein said antenna feed engages an electrically conductive surface of a printed circuit board.

* * * * *